US007857630B2

(12) United States Patent
Hermant et al.

(10) Patent No.: US 7,857,630 B2
(45) Date of Patent: Dec. 28, 2010

(54) PRINTED CIRCUIT BOARD MOUNTED CONNECTOR HOUSING SHIELDED CABLES

(75) Inventors: Stéphane Hermant, Etampes/Marne (FR); Gilles Rouchaud, Montmirail (FR)

(73) Assignee: Axon'Cable, Montmirail (FR)

( * ) Notice: Subject to any disclaimer, the term of this patent is extended or adjusted under 35 U.S.C. 154(b) by 75 days.

(21) Appl. No.: 12/298,018

(22) PCT Filed: Apr. 20, 2007

(86) PCT No.: PCT/FR2007/051143

§ 371 (c)(1),
(2), (4) Date: Nov. 17, 2008

(87) PCT Pub. No.: WO2007/122349

PCT Pub. Date: Nov. 1, 2007

(65) Prior Publication Data

US 2009/0197433 A1 Aug. 6, 2009

(30) Foreign Application Priority Data

Apr. 21, 2006 (FR) ..... 06 51396

(51) Int. Cl.
*H01R 12/00* (2006.01)

(52) U.S. Cl. ..... 439/63

(58) Field of Classification Search ..... 439/63, 439/497, 607.43

See application file for complete search history.

(56) References Cited

U.S. PATENT DOCUMENTS

| | | | | |
|---|---|---|---|---|
| 5,090,919 | A | 2/1992 | Tsuji | |
| 5,114,364 | A * | 5/1992 | Hunter | 439/497 |
| 6,692,262 | B1 * | 2/2004 | Loveless | 439/63 |
| 2004/0029406 | A1 | 2/2004 | Loveless | |
| 2005/0181670 | A1 * | 8/2005 | Kumamoto et al. | 439/607 |

FOREIGN PATENT DOCUMENTS

EP 0 520 283 A1 12/1992

* cited by examiner

*Primary Examiner*—Edwin A. Leon
*Assistant Examiner*—Vanessa Girardi
(74) *Attorney, Agent, or Firm*—Kenyon & Kenyon LLP

(57) ABSTRACT

Connector for high-speed two-wire link, able to be mounted directly on a printed circuit. The connector comprises two parallel pins, an insulating insert in which the pins are mounted, a metal casing associated with mounting means for the fixing thereof onto a printed circuit and two shielded linking cables, each linked to a pin.

9 Claims, 4 Drawing Sheets

PRINTED CIRCUIT BOARD MOUNTED CONNECTOR HOUSING SHIELDED CABLES

This is a 371 national phase application of PCT/FR2007/051143 filed 20 Apr. 2007, which claims priority to French Patent Application No. FR 06/51396 filed 21 Apr. 2006, the contents of which are incorporated herein by reference.

FIELD OF THE INVENTION

The invention relates to a connector able to be used in a link for high-speed digital signals and designed to afford minimum disturbance to the signals transferred. The invention relates more particularly to a connector able to be mounted directly on a printed-circuit electronic card comprising means for processing such signals transmitted via said connector. The invention also relates to such an electronic card furnished with at least one connector of this type.

BACKGROUND OF THE INVENTION

When one desires to establish a disconnectable digital link between two electronic subunits (such as for example two printed-circuit electronic cards) comprising active components capable of processing high-speed digital information, it is necessary to interpose between these two subunits at least one pair of connectors with male and female pins, respectively. These connectors must be designed so as not to impair the quality of the signals transmitted at high speed. One generally speaks of high-speed digital information when said information is transmitted at a rate of the order of 100 megabits per second or more.

These connectors must be designed so as not to impair the quality of the signals transmitted. An advantageous solution consists in mounting one of the connectors directly on the card. In this case, such a connector must be engineered to ensure good protection in relation to outside electromagnetic disturbances and to modify as little as possible the predetermined constant impedance of the transmission lines generally used at such speeds. It is recalled that the shielded cables used for these high-speed links exhibit a characteristic, constant impedance. The connector must therefore be engineered so that this impedance does not vary significantly at the linkup level. Stated otherwise, the transition between the connector and the printed circuit must be impedance matched.

SUMMARY OF THE INVENTION

The invention makes it possible to achieve the objectives mentioned above.

More particularly, the invention relates to a connector making it possible to establish a link with at least one constant-impedance two-wire high-speed transmission line and able to be mounted directly on a printed-circuit electronic card, characterized in that it comprises at least:

- two parallel pins,
- an insulating insert in which said pins are mounted,
- a metal casing comprising an open sleeve accommodating said insert and said pins, said casing comprising or being associated with mounting means for the fixing thereof onto said card, and
- two linking cables shielded by at least one outer braid, each cable being linked to a pin and the braid being linked to said metal casing.

Preferably, the two linking cables consist of two distinct shielded cables, with coaxial structure, each comprising a central core linked to a corresponding pin and a braid linked to said metal casing.

The type of connector defined above can advantageously be obtained through an appropriate modification of a connector complying with the MIL DTL 83513 standard. This standard defines a type of connector known in the art by the name "micro-D".

In particular, polarization is obtained through the D shape of the metal sleeve of the casing of the connector, accommodating the pins.

The connector described above, particularly designed to be mounted directly on a printed circuit, cooperates with a similar connector, which will not be described in detail here, linked to a shielded two-wire transmission line.

Advantageously, the casing comprises a metal wall, on the side opposite from said sleeve and just where each braid is linked, for example soldered to this wall. Said wall can be a metal plate (a single copper hoop) fixed to the remainder of the metal casing accommodating the two pins and the insulating insert. The metal wall then comprises two holes for the passage of the linking cables.

Advantageously, the shielded cables are of the semi-rigid type; they are therefore pliant at will. Such a cable can consist, conventionally, of a central core consisting of a single rigid but pliable arm, surrounded by a flexible braid.

For example, said metal casing can be fixed to an insulating material support comprising the aforesaid mounting means. The linking cables can then be immobilized in this support, for example by means of a resin molded in a cavity thereof.

The invention also relates to an electronic card for processing high-speed signals, characterized in that it comprises at least one connector according to the preceding definition, fixed to it and whose linking cables are connected, for example soldered, to conductors of said printed circuit.

BRIEF DESCRIPTION OF THE DRAWINGS

The invention will be better understood and other advantages thereof will become better apparent in light of the description which follows given solely by way of example and with reference to the appended drawings in which.

DETAILED DESCRIPTION

Figure 1:
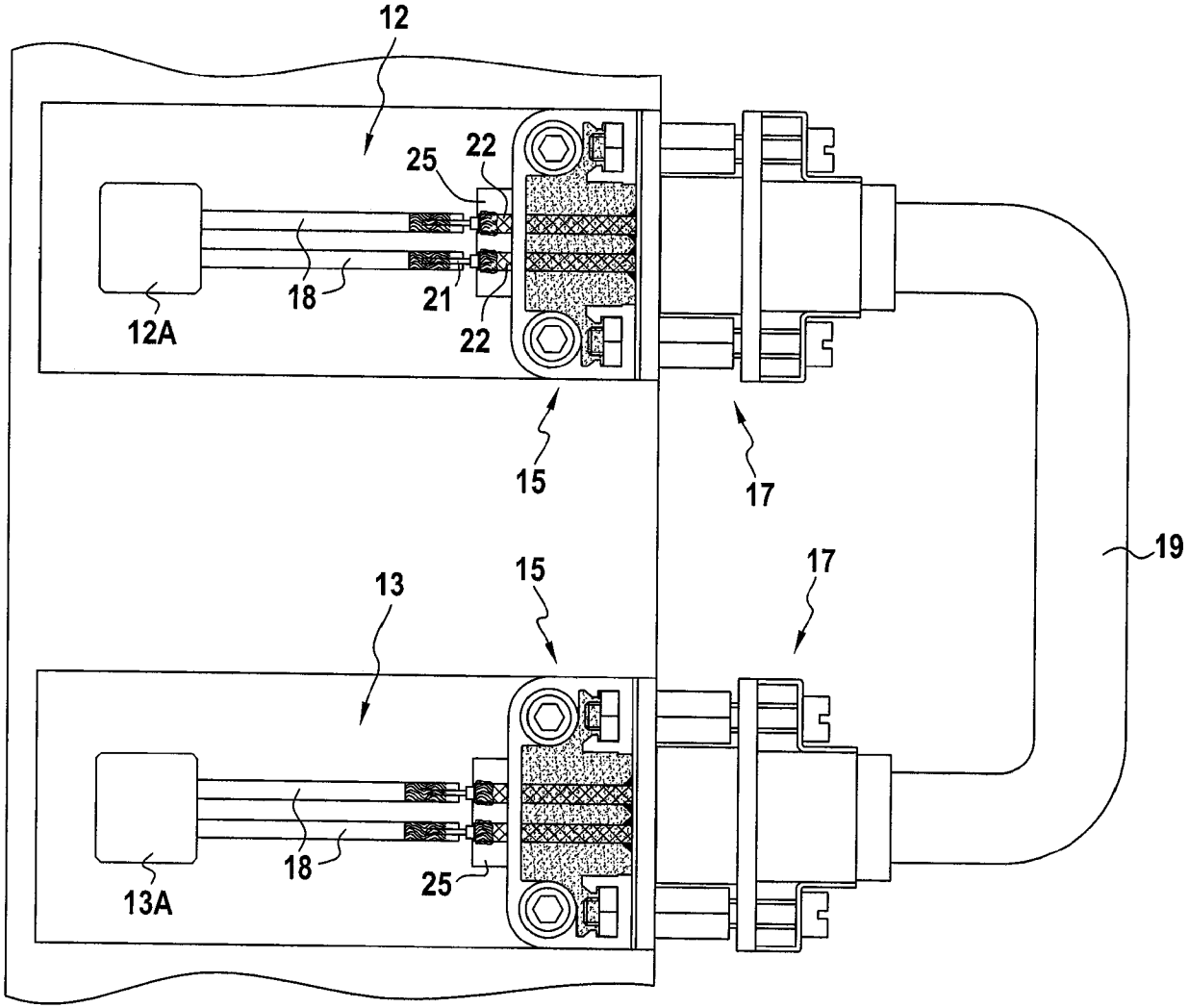
FIG. 1 illustrates a high-speed digital signals link established between two printed-circuit electronic cards and using connectors in accordance with the invention.

FIG. 1 illustrates an exemplary linkup between two printed circuits, by a high-speed two-wire link. The printed circuit 12 carries an active component 12A (for example an integrated circuit termed a "router") which has to be linked to another analogous active component 13A carried by a printed circuit 13. A connector 15 of the "socket" type, in accordance with the invention is mounted on each printed circuit 12, 13. Each connector 15 is able to cooperate with a corresponding connector 17, of the "plug" type to which is linked a suitably matched wire link 19, for example consisting of a pair of shielded wires, of 100 ohms differential characteristic impedance.

Figure 2:
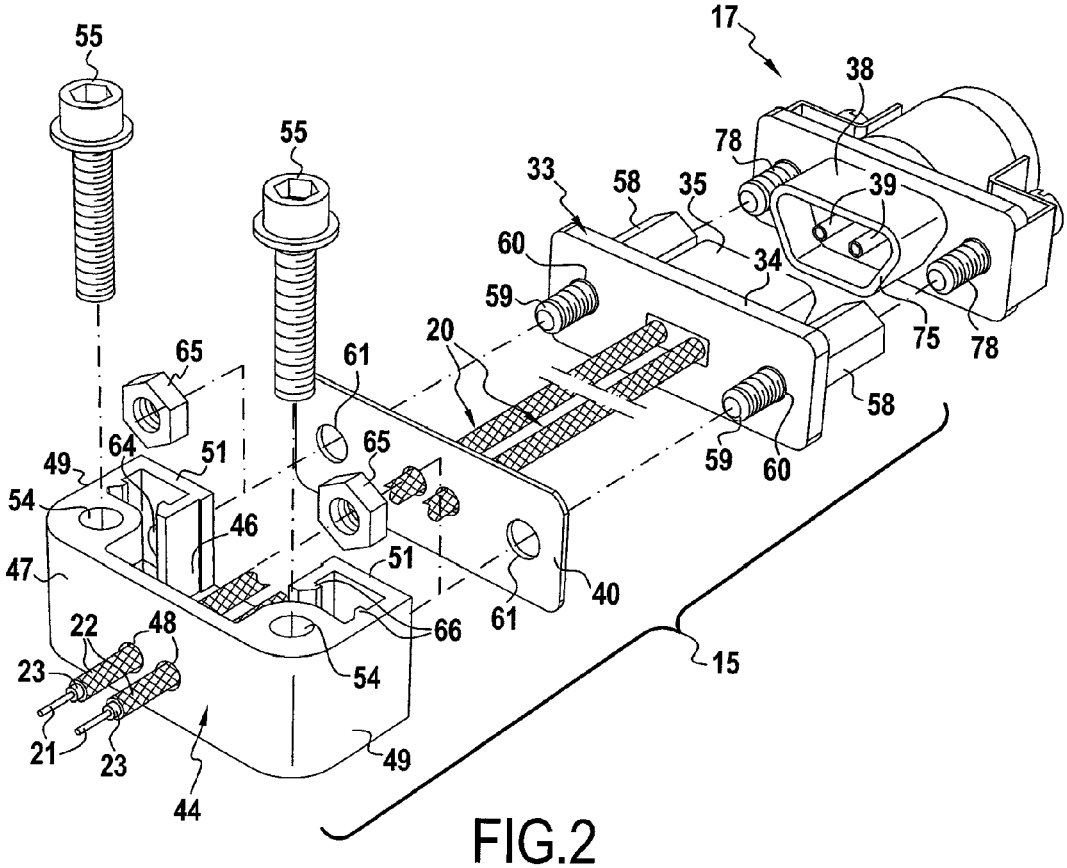
FIG. 2 is an exploded perspective view of a connector according to the invention.
Figure 3:
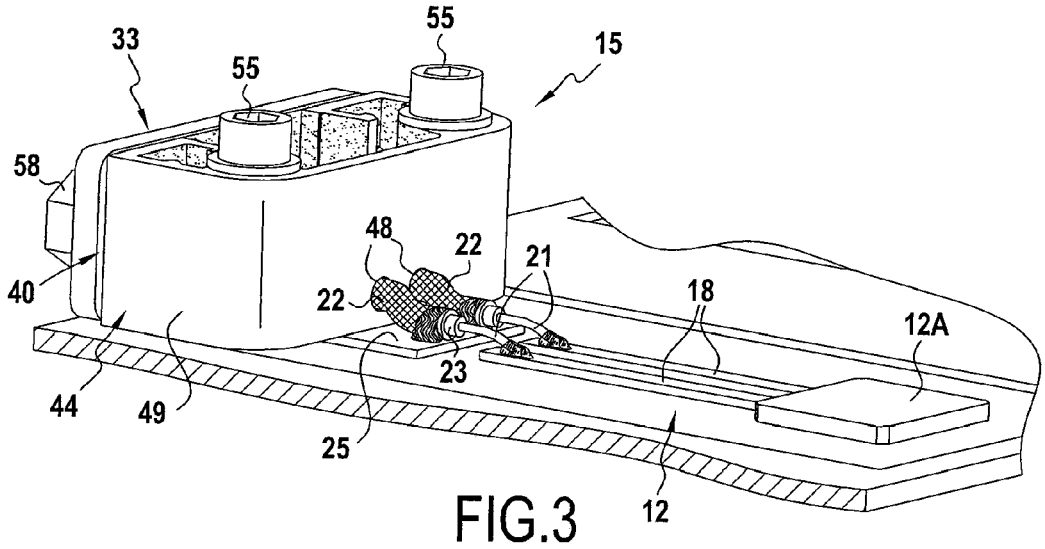
FIG. 3 illustrates the connector installed on a printed-circuit card.
Figure 4:
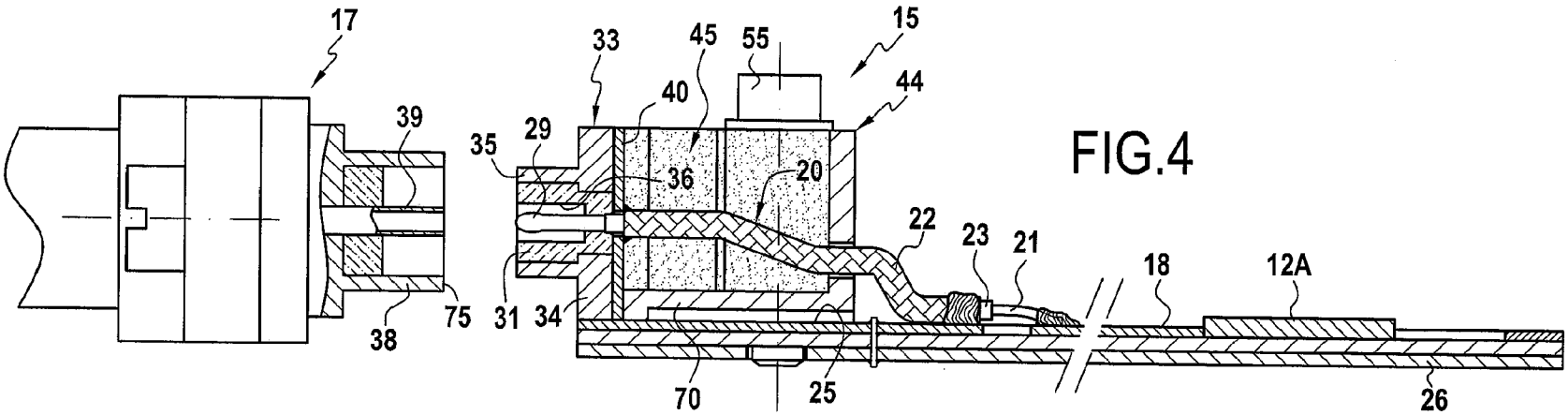
FIG. 4 is a sectional view of the connector, installed on the card and of a similar connector, before they are linked up.
Figure 5:
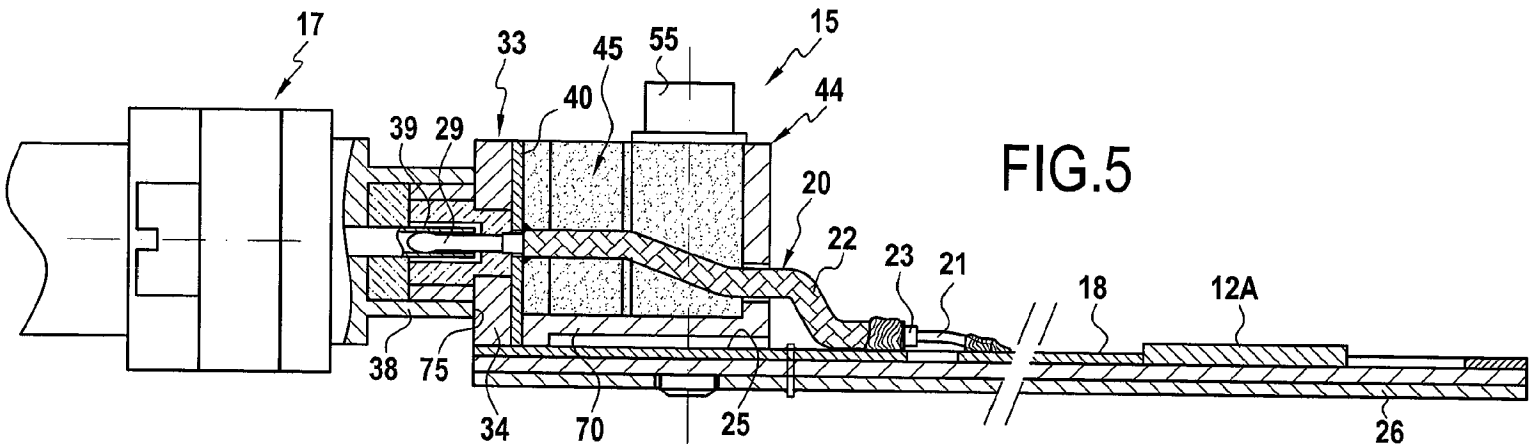
FIG. 5 is a view analogous to FIG. 4, after linkup.

On each printed circuit 12, 13 the link between the connector 15 and the active component is effected by printed-circuit conductors, namely here by two parallel lines 18 spaced a predetermined distance apart and separated by a ground plane to preserve the differential impedance of 100 ohms. The output of the connector 15 is preferably effected by two shielded linking cables 20, with coaxial structure (FIG. 2) of characteristic impedance equal to half that previously cited, each comprising a central core 21 and a braid 22. The core and the braid are separated by a coaxial sleeve 23 made of insulating material.

On the printed circuit, a central core 21 such as this is soldered to one of the parallel lines 18 and the braid is soldered to one and the same conductor 25 of the printed circuit, forming a ground. The latter, situated in the vicinity of the linking points between said cores 21 and the two conductors forming said parallel lines 18, is itself linked to another ground plane 26 on the other face of the printed circuit.

In the example of FIGS. 1 to 5, said conductor 25 forming a ground and said two conductors forming said parallel lines 18 are on the same face of the printed circuit 12 or 13.

Figure 6:
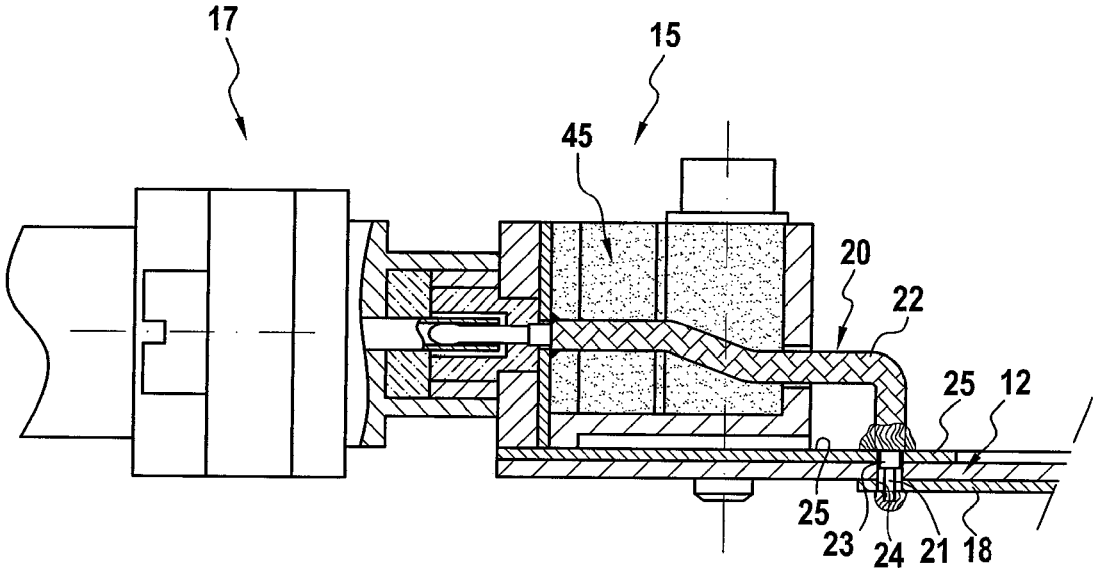
FIG. 6 is a sectional view illustrating a variant of plugging the connector onto the printed-circuit card.

In the example of FIG. 6, conversely, the conductor 25 forming a ground is defined on a face of the printed circuit 12 on which the connector 15 is situated while the two conductors forming the parallel lines 18 are defined on the other face. In this case, the cores 21 of said linking cables cross through the printed circuit by passing through holes 24 made for this purpose and are connected to said two conductors 18 on the other face of the printed circuit, here by soldering. The braids 22 of the two coaxial cables are soldered onto the ground-forming conductor 25 defined on the face of the printed circuit which carries the connector 15. The braid does not cross the printed circuit. The core and the coaxial insulant which separates it from the braid are the only parts of the cable which engage in the hole 24.

The connector 15 (FIGS. 2 to 5) intended to be mounted directly on the printed circuit comprises at least:

- two parallel pins 29, here of the male type (but which could be of female type);
- an insulating insert 31 in which the pins are mounted;
- a metal casing 33 comprising a base 34 and an open sleeve 35, accommodating said insert and said pins; and
- two linking cables shielded by at least one outer braid.

The example involves the two cables 20 with coaxial structure each comprising a braid 22.

The insert 31 accommodates only two pins 29 to which the central cores 21 of the cables 20 are linked. The male pins 29 are fully integrated into the corresponding insert and each extends axially in a hole 36 of this insert. The diameter of this hole is just sufficient to receive the corresponding female pin 39 of the connector 17.

The dielectric characteristics of the insert and the separation of the pins condition a characteristic impedance variation that is as low as possible in the connector. Moreover, the braid 22 of each cable is linked to the casing. In the example, said casing comprises a metal wall 40 (a sort of copper hoop) overlaid on a face of the base 34, on the side opposite from said sleeve 35. Just where each braid 22 is linked, for example soldered, to this wall.

To summarize, before mounting on the printed circuit, the connector comprises two linking cables 20 such as described, consisting of two shielded cables with coaxial structure, each comprising a central core linked to a corresponding pin and a braid linked to said metal casing.

The linking cables 20 are of the semi-rigid type and are consequently pliant. This makes it possible to envisage various types of linkup to the printed circuit as described above with reference to FIGS. 5 and 6, respectively.

The aforesaid metal casing 33 is associated with (here fixed to) mounting means for its own mechanical fixing to the printed circuit 12 or 13. In the example, said metal casing is fixed to an insulating material support 44 comprising the aforesaid mounting means. The support 44 comprises a rear wall 47, two lateral walls 49 and two coplanar mounting webs 51 prolonging the lateral walls inwards, for assembly. The parts of the two linking cables 20 passing through the support 44 are immobilized in the latter, preferably by means of a resin 45 molded in a cavity 46 of said support. Each of the cables 20 exits the connector through a hole 48 made in the rear wall 47 of said support.

The separation of these holes as well as the separation of the linking cables in the support is dependent on the separation of the conductors forming said parallel lines 18 of the printed circuit to which they are intended to be connected.

The support 44 comprises two ducts 54 allowing the passage of two fixing screws 55 for mounting the connector on the printed circuit. Two internally tapped posts 58 project from the base of the metal casing 33 at the front of the connector, on either side of the sleeve, for fixing the other connector 17. Threaded portions 59 of these posts engage in holes 60 of the base and pass through holes 61 in the metal wall before engaging in the insulating material support. The mounting webs are drilled with two holes 64 and the threaded portions of the posts pass through these holes and cooperate with nuts 65 bearing on the internal faces of said mounting webs 51. The nuts are held captive by inner ribs 66 of the support. It is therefore the mounting of the posts 58, by virtue of the nuts 65, which ensures assembly of all the elements of the connector, including the metal wall 40 interposed between the metal casing and the plastic support 44.

The support 44 also comprises a bottom 70. It is therefore easy, after assembling the elements by means of said posts, to cast the hardenable resin 45 in said support thereby stabilizing the cables inside the latter and immobilizing the nuts 65. The sleeve 35 of the metal casing has a polarization contour similar to that of the sleeve 38 of the corresponding connector 17. In the example specifically described, this contour has a D shape, known per se.

One of the connectors comprises an aforesaid metal sleeve termed the outer sleeve (here this is the sleeve 38 of the connector 17) of larger section than that of the sleeve 35 (termed the inner sleeve of the connector 15), so as to slide along the latter during the coupling of the two connectors. This is illustrated more particularly by FIGS. 4 and 5.

Furthermore, according to another advantageous characteristic, the outer sleeve has a sufficient length for its free end 75 to come into electrical contact with a base 34 of the connector comprising the inner sleeve. It should be noted that, involving as it does the MIL DTL 83513 standard defining the general architecture of a "micro D" connector, it does not favor this end-on electrical contact.

This end-on electrical contact, made possible and confirmed by the screws 78 for assembling the two connectors, engaged in the posts 58, considerably improves the electromagnetic compatibility (CEM or "RFI/EMI protection") of the high-speed connection.

In the embodiment represented the female pins 39 of the connector 17 project from the insert which holds them in an open cavity delimited by the sleeve 38 which surrounds them, the latter being the outer sleeve.

The embodiment such as illustrated is currently preferred but it would be perfectly possible to design an inverse structure in which the male pins 29 project from the corresponding insert and the female pins 39 are fully integrated into their own insert. Of course, the male pins could be housed in a so-called outer sleeve and the female pins could be housed in a so-called inner sleeve.

The connector represented is of the type with one pathway; it comprises only a single sleeve accommodating an insert and a pair of pins.

However, one and the same connector mounted on a printed circuit can comprise a larger number of sleeves, for simultaneously linking a corresponding number of lines. In this case, each sleeve forming part of the same metal casing accommodates an insert and two pins. The sleeves are arranged side by side and in a single row. In this case, provision may be made for a longer support fixed to the rear face of the base of the metal casing (with interposition of a metal plate) and accommodating as many shielded cable pairs as there are sleeves.

The invention claimed is:

1. A connector configured to establish a link with a constant-impedance two-wire high-speed transmission line and configured to be mounted directly on a printed-circuit electronic card, comprising at least:

two parallel pins, an insulating insert in which said pins are mounted, a metal casing comprising an open sleeve accommodating said insert and said pins, said casing comprising an insulating material support to attach said casing onto said printed-circuit electronic card, and two linking cables shielded by outer braids, each cable being linked to one of the two parallel pins and the braids being linked to said metal casing, wherein said casing comprises a metal wall located on a side of said casing where each braid is linked to the metal wall, the side being opposite to another side of said casing where said open sleeve is located.

2. The connector as claimed in claim 1, wherein parts of said two linking cables are immobilized in said support, by means of a resin molded in a cavity thereof.

3. A pair of connectors one of which is as claimed in claim 1, wherein one of the connectors comprises an outer sleeve of larger cross-section than that of a corresponding inner sleeve of the other connector so as to slide along the inner sleeve during the coupling of the two connectors and said outer sleeve has a sufficient length for its free end to come into electrical contact with a base of the connector comprising the inner sleeve.

4. The connector as claimed in claim 1, wherein the two linking cables having coaxial structure, each comprising a central core linked to a corresponding pin of the two parallel pins.

5. The connector as claimed in claim 4, wherein said shielded cables are of the pliant, semi-rigid type.

6. An electronic card for processing high-speed signals, which comprises at least one connector the at least one connector, further comprising:

two parallel pins, an insulating insert in which said pins are mounted, a metal casing comprising an open sleeve accommodating said insert and said pins, said casing comprising an insulating material support to attach said casing onto said electronic card, and two linking cables shielded by outer braids, each cable being linked to one of the two parallel pins and the braids being linked to said metal casing, wherein said casing comprises a metal wall located on a side of said casing where each braid is linked to the metal wall, the side being opposite to another side of said casing where said open sleeve is located, and wherein said metal casing is fixed to an insulating material support comprising said mounting device, wherein the at least one connector is fixed to the linking cables which are connected to a conductor on a first face of said electronic card.

7. The electronic card as claimed in claim 6, wherein the two linking cables having a coaxial structure and each comprising a central core and an outer braid, and wherein said cores are respectively soldered to two conductors of said electronic card, and said braids are soldered to another conductor of said electronic card, forming a ground, in the vicinity of linking points between said cores and said two conductors.

8. The electronic card as claimed in claim 7, wherein said another conductor forming the ground and said two conductors are on the same first face of said electronic card.

9. The electronic card as claimed in claim 7, wherein said another conductor forming a ground is defined on a face of the electronic card on which said connector is situated, and wherein said two conductors are defined on a second face and the cores of said linking cables pass through said electronic card and are connected to said two conductors on the second face of said electronic card.

* * * * *